US005291096A

United States Patent [19]

Lee

[11] Patent Number: 5,291,096

[45] Date of Patent: Mar. 1, 1994

[54] CATHODE STRUCTURE FOR A CATHODE-RAY TUBE

[75] Inventor: Gyeong S. Lee, Kyungsangbook, Rep. of Korea

[73] Assignee: Goldstar Co., Ltd., Rep. of Korea

[21] Appl. No.: 812,468

[22] Filed: Dec. 23, 1991

[30] Foreign Application Priority Data

Dec. 29, 1990 [KR] Rep. of Korea ..... 90-21699

[51] Int. Cl.[5] ..... H01J 29/48

[52] U.S. Cl. ..... 313/446; 313/456

[58] Field of Search ..... 313/446, 456

[56] References Cited

U.S. PATENT DOCUMENTS 3,333,138 7/1967 Szegho ..... 313/446 X

*Primary Examiner*—Sandra L. O'Shea

*Attorney, Agent, or Firm*—Morgan & Finnegan

[57] ABSTRACT

A cathode structure for a cathode-ray tube includes a cathode cap coated with an electron-emissive substance for emitting electrons when heated, a cylindrical cathode sleeve attached to the bottom of the cathode cap, a heater inserted in the cathode sleeve for heating the cathode cap, a cathode sleeve holder for holding the cathode sleeve, a cylindrical member for fixing the lower end of the cathode sleeve preventing electric field concentration, and a plurality of connecting arms extending from the means for connecting with the cathode sleeve holder.

2 Claims, 1 Drawing Sheet

CATHODE STRUCTURE FOR A CATHODE-RAY TUBE

FIELD OF THE INVENTION

The present invention relates to a cathode structure for a cathode-ray tube, and more particularly to a connecting means for fixedly connecting a cathode sleeve and cathode sleeve holder.

TECHNICAL BACKGROUND

A conventional cathode structure for a cathode-ray tube, as shown in FIGS. 1A and 1B, comprises a cathode cap 13 coated with an electron-emissive substance 14 for emitting electrons when heated, a heater for heating the cathode cap, a cylindrical cathode sleeve 12 of Ni-Cr alloy for radiating the heat generated from the heater, a cathode sleeve holder 11 for holding the cathode sleeve 12, and a plurality of metal ribbons 16 for fixedly connecting the cathode sleeve 12 and cathode holder 11.

One end of the metal ribbons 16 is attached to the lower end of the cathode sleeve 12, and the other end to the upper surface of the cathode holder 11, so as to fix the cathode sleeve to the cathode sleeve holder. The reason that the metal ribbons 16 are employed to fix the cathode sleeve to the cathode sleeve holder is to prevent the heat transferred from the heater to the cathode sleeve 12 from being easily lost towards the cathode sleeve holder 11.

It is very important that the heat from the heater is transferred to the cathode cap 13 coated with the electron-emissive substance 14 without considerable heat lost, which reduces the power consumption of the heater, the time taken for the image to appear on the screen of the cathode-ray tube, and the temperature of the cathode sleeve holder and thus the current change of the cathode caused by the heat. Further, to this end, the cathode sleeve is blackened to improve the heat radiation. The cathode sleeve is made of Ni-Cr alloy, and blackened by oxidizing the Cr component in a wet hydrogen ambient. In addition, as shown in FIGS. 1A and 1B, metal ribbons are employed to fix the cathode sleeve to the cathode sleeve holder, thereby reducing the heat loss.

However, the following problems are caused by the metal ribbons of which one end is simply connected to the lower end of the cathode sleeve 12 and the other end to the upper surface of the cathode sleeve holder 11. Namely, the electric field formed around the cathode is concentrated on a plurality of projections 17 that are formed in the lower end portion of the cathode sleeve 12 by the metal ribbons 16, so that there may occur electric discharge between the heater 15 and the projections 17 to cut off the heater.

SUMMARY OF THE INVENTION

It is an object of the present invention to provide a stable cathode structure wherein there does not occur the electric discharge between the lower end of the cathode sleeve and the heater thus preventing the heater being cut off, and the heat of the heater is hardly transferred to the cathode sleeve holder.

According to the present invention, a cathode structure for a cathode-ray tube comprises a cathode cap coated with an electron-emissive substance for emitting electrons when heated, a cylindrical cathode sleeve attached to the bottom of the cathode cap, a heater inserted in the cathode sleeve for heating the cathode cap, a cathode sleeve holder for holding the cathode sleeve, a means for fixing the lower end of the cathode sleeve preventing electric field concentration, and a plurality of connecting arms extended from the means for connecting with the cathode sleeve holder.

The present invention will now be described more specifically with reference to the drawings attached only by way of example.

BRIEF DESCRIPTION OF THE ATTACHED DRAWINGS

DETAILED DESCRIPTION OF THE INVENTION

Figure 1A:
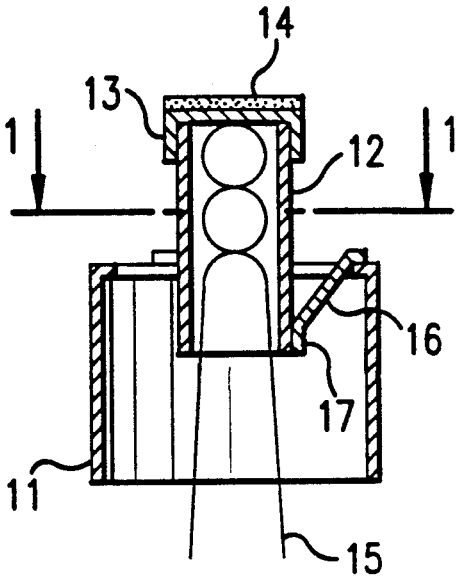
FIG. 1A illustrates a longitudinal cross section of a conventional cathode structure.
Figure 1B:
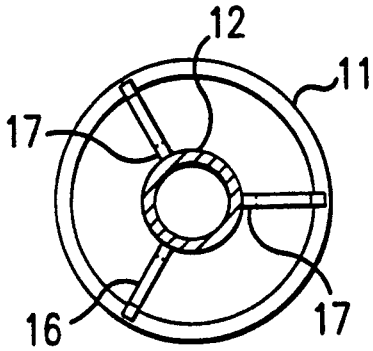
FIG. 1B is a cross sectional view taken along line 1—1 of FIG. 1A.
Figure 2A:
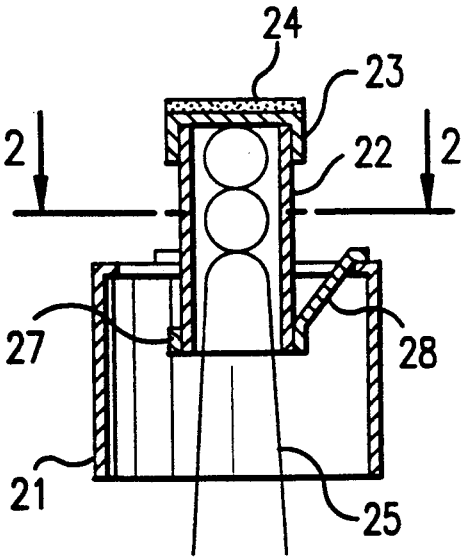
FIG. 2A illustrates a longitudinal cross section of the inventive cathode structure.
Figure 2B:
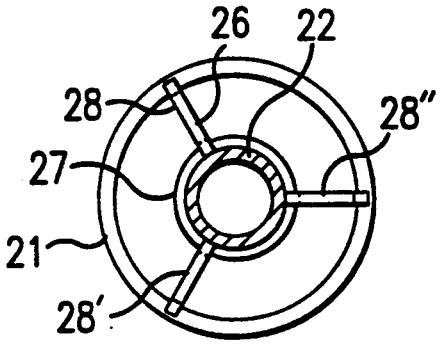
FIG. 2B is a cross sectional view taken along line 2—2 of FIG. 2A.

As shown in FIGS. 2A and 2B, a cathode structure according to the present invention comprises a cathode cap 23 coated with an electron-emissive substance 24, a cylindrical cathode sleeve 22 attached to the bottom of the cathode cap 23, a heater 25 inserted in the cathode sleeve 22 for heating the cathode cap, a cathode sleeve holder 21 for holding the cathode sleeve, a means for fixing the lower end of the cathode sleeve with preventing electric field concentration, and a plurality of connecting arms extended from the means for connecting with the cathode sleeve holder. The means for fixing the lower end of the cathode sleeve and the connecting arms constitute a supporting member 26. The means is a cylindrical part 27 for fixedly receiving the lower end of the cathode sleeve 22. The connecting arms 28, 28', 28'' are integrally formed with the cylindrical part 27, and attached to the upper surface of the cathode sleeve holder 21. The lower end of the cathode sleeve 22 is inserted in the cylindrical part 27 and fixed thereto. Then the lower part of the cathode sleeve 22 is positioned in the cathode sleeve holder 21 together with the cylindrical part, whose radially extended connecting arms 28, 28', 28'' are fixed to the upper surface of the cathode sleeve holder 21.

In operation, when the heater inside the cathode sleeve is heated by an externally applied voltage source, electrons are emitted from the electron-emissive substance 24 laid on the cathode cap 23. In this case, since the cylindrical part 27 for fixedly receiving the lower end of the cathode sleeve has no peripheral projections, the electric field concentration does not occur, thus preventing the electric discharge and cutting-off of the heater.

Although the present invention has been described in connection substantially a certain preferred embodiment, it will be appreciated by those skilled in the art that various modifications can be made to the embodiment without departing the spirit of the present invention.

What is claimed is:

1. A cathode structure for a cathode-ray tube comprising:

a) a cathode cap coated with an electron-emissive substance for emitting electrons when heated;

b) a cylindrical cathode sleeve having first lower and upper ends, and attached to the bottom of said cathode cap;

c) a heater inserted in said cathode sleeve for heating said cathode cap;

d) a cathode sleeve holder having second lower and upper ends, and for holding said cathode sleeve;

e) a cylindrical member affixed to the first lower end of said cathode sleeve substantially preventing electric field concentration; and f) a plurality of connecting arms having third lower and upper ends and the third lower end connected to said cylindrical member, and each of said plurality of connecting arms extending upwardly from said cylindrical member and connected to said second upper end of said cathode sleeve holder via said third upper end, and each of said plurality of connecting arms positioned above said first lower end of said cathode sleeve.

2. A cathode structure as claimed in claim 1, wherein said plurality of connecting arms are integrally formed with said cylindrical member.

* * * * *